US011339951B2

(12) United States Patent
Britt

(10) Patent No.: US 11,339,951 B2
(45) Date of Patent: May 24, 2022

(54) PRESSURE ADJUSTOR TO PREVENT CONTAMINATION OF LED ENCAPSULATED ATMOSPHERE

(71) Applicant: Paul E. Britt, Los Angeles, CA (US)

(72) Inventor: Paul E. Britt, Los Angeles, CA (US)

( * ) Notice: Subject to any disclaimer, the term of this patent is extended or adjusted under 35 U.S.C. 154(b) by 0 days.

(21) Appl. No.: 17/022,378

(22) Filed: Sep. 16, 2020

(65) Prior Publication Data

US 2021/0080082 A1 Mar. 18, 2021

Related U.S. Application Data

(60) Provisional application No. 62/900,790, filed on Sep. 16, 2019.

(51) Int. Cl.

| | |
|---|---|
| ***F21V 15/01*** | (2006.01) |
| ***F21V 23/00*** | (2015.01) |
| ***F21V 31/00*** | (2006.01) |
| ***F21Y 115/10*** | (2016.01) |

(52) U.S. Cl.

CPC ..... *F21V 15/012* (2013.01); *F21V 23/002* (2013.01); *F21V 23/004* (2013.01); *F21V 31/005* (2013.01); *F21Y 2115/10* (2016.08)

(58) Field of Classification Search

CPC .... F21V 15/012; F21V 23/002; F21V 23/004; F21V 31/005; F21Y 2115/10

See application file for complete search history.

(56) References Cited

U.S. PATENT DOCUMENTS 9,574,760 B1 * 2/2017 Olsson ..... F21V 7/00

FOREIGN PATENT DOCUMENTS

| | | | |
|---|---|---|---|
| CN | 202209591 U | * | 5/2012 |
| CN | 107816711 A | * | 3/2018 |
| CN | 109519743 A | * | 3/2019 |
| KR | 2029959 B1 | * | 10/2019 |
| KR | 102029959 B1 | * | 10/2019 |

* cited by examiner

*Primary Examiner* — Mary Ellen Bowman

(74) *Attorney, Agent, or Firm* — Thomas A. Runk; Brooks Kushman P.C.

(57) ABSTRACT

An LED light source with a lens is mounted to a light housing. The lens is sealed to form an encapsulated atmosphere about the LED. The housing has a cylinder and a divider between the cylinder and the LED. A slidable and sealed piston in the cylinder creates an air chamber between its upper surface and the divider and a lower surface of the piston is exposed to air pressure of the outer atmosphere. A conduit is formed through the divider to interconnect the encapsulated atmosphere with the air chamber in the cylinder. LED heat causes the pressure of the encapsulated atmosphere to increase, and it flows through the conduit to press against the piston. This piston slides to create a larger air chamber to equal the increased pressure of the encapsulated atmosphere to the pressure of the outside atmosphere. The reverse occurs when the LED cools.

18 Claims, 5 Drawing Sheets

PRESSURE ADJUSTOR TO PREVENT CONTAMINATION OF LED ENCAPSULATED ATMOSPHERE

CROSS-REFERENCE TO RELATED APPLICATIONS

This application claims the benefit of U.S. Provisional Application No. 62/900,790, filed Sep. 16, 2019, which is incorporated herein by reference.

TECHNICAL FIELD

The invention relates generally to pressure and moisture control in light fixtures and more particularly, to the control of internal pressure in a light fixture to protect a light source from degradation.

BACKGROUND

Light-emitting diodes (LEDs) have become a major light source technology used in mainstream commercial lighting applications. The number of manufacturers offering white light LED devices, LED drivers, and light fixtures continues to grow. LEDs claim many advantages over traditional lamps (incandescent, high intensity discharge, and fluorescent), namely durability and longevity. Despite these benefits, a challenge with LED lighting is its relatively high initial purchase price tag. But as with all new technologies, the cost is decreasing to a more competitive level. LEDs can be used in almost any light fixture.

LEDs are far more efficient than older types of light sources. However, they are still not 100% efficient in turning electricity into light. Some of that electricity is turned into heat, either by the LEDs themselves or by their driver circuits. LEDs are semiconductor devices that produce visible light when electric current passes through them. LED lighting can cut energy usage by about 85%. While energy conversion efficiency of incandescent lamps is between 10% to 20%, highly efficient LEDs currently achieve efficiency values between 40% to 60%. Nevertheless, this means that forty to sixty percent of the power is lost as heat. This heat can negative effects.

As of 2016, many LEDs use only about 10% of the energy an incandescent light source requires. Similar to incandescent light sources (and unlike most fluorescent light sources), LEDs come to full brightness immediately with no warm-up delay. At lower power levels, the LED is even more efficient and can use only 11 watts to 12 watts while creating a light output comparable to a 50-watt incandescent bulb.

LEDs can experience electrical over-stress (EOS) events. There are many different reasons and ways in which an EOS could happen to an LED, but there is only one result: the LED fails. EOS damages the LED chip structure which causes it to fail faster than its expected lifetime. For this reason, carefully designed LED driver circuits have been designed. The LED module itself may include various circuitry that lessens the chances of an EOS event, such as resistors and/or capacitors in the circuit line. These drivers and additional circuit elements used to control the light output of the LED contribute to heat losses. But because of this circuitry, LEDs typically do not suddenly break and stop emitting light, they will eventually just not be bright enough to be useful.

A problem with LED outdoor landscape lighting fixtures is the LED device deteriorates if it has moisture in its atmosphere. It is a relatively simple task to make sure the atmosphere at assembly of the LED device in a light source enclosure in a lighting fixture is dry or at an acceptable humidity level. However, once the LED device is put into use, it has the potential to change its originally dry atmosphere inside its lighting enclosure by its continued normal operation. This happens by the continued heating and cooling of the LED device as it is placed into the "on" and "off" states. If the LED device enclosure is located in a typical metal housing, the metal housing expands and contracts on every operation cycle. Over an extended period of time, these expansions and contractions will break normal seals. Once the seal is broken the heated atmosphere from operation will expel air from the LED light source enclosure to the outside atmosphere. When the LED and housing cool, air from the outside uncontrolled atmosphere will be drawn into the LED light source enclosure and into contact with the LED device because of the negative pressure created in the LED light source enclosure. If it is a moist day, the cooling LED device will cause the LED light source enclosure to draw in moist air. This leads to the condensation of moisture in the enclosure and on the LED device itself and thereby introduces the possibility of harming the LED device. This is especially harmful if sulfur dioxide ($SO_2$) is present in the atmosphere and is sucked into contact with the LED device. Sulfur dioxide and other corrosive gases significantly shorten the life of an LED device.

In some cases, the LED device is mounted on a mounting site of a housing under a lens that is sealed to the mounting site to prevent outside atmospheric air and moisture that may be in the air from reaching the LED device under the lens.

The well-known Gay-Lussac's pressure-temperature law of physics accounts for the problem of breaking the seals and expelling air from, and drawing air into, the LED device enclosure. According to this law of physics, raising the temperature of air inside a fixed volume causes the air in the fixed volume to expand. Because it is a fixed volume, the expanded air will exert more pressure against the walls of the fixed volume resulting in a strain or damage to any seals of the fixed volume. This very scenario occurs when a light source that creates heat is turned on inside a fixed volume. This even occurs when LEDs are used as the light source because, as explained above, LEDs create heat when operating. Then, when the LED device is turned off, it will cease creating heat, the temperature of the air in the fixed volume will decrease causing the pressure inside the fixed volume to decrease and outside air will be drawn into the fixed volume through the damaged seals.

Outside atmospheric air having moisture will be drawn into the light source enclosure and will cause condensation to form on the inside of the light source enclosure and on the LED device. This will cause corrosion of the LED and ultimate failure as discussed above. It is not uncommon for service or repair work on LED light fixtures to involve recaulking of LED housing openings. In especially high-humidity applications, moisture creep has been found to be a considerable problem.

Hence those of skill in the art have recognized a need for an improved LED lighting fixture that resists exposing the LEDs to outside atmospheric air that may have moisture or other contaminants in it. Another need has been recognized for providing pressure control over LED lighting fixture enclosures so that seals are not broken by the normal use of the LED device and the heat it creates. Yet another need has been recognized for a system that will equalize the internal atmospheric pressure in an LED enclosure with the external atmospheric pressure outside the light fixture. Yet another need has been recognized for providing protection of the LED device light source against external corrosive air in a cost-effective system and method that is easily implemented in a light fixture. A need also exists for a system and method for assembling such an LED light fixture more easily and at lower expense. The present invention fulfills these needs and others.

SUMMARY OF THE INVENTION

Briefly and in general terms, the present invention is directed to a pressure adjustor system and method that prevents contamination of an encapsulated atmosphere located about a light source. In particular, there is provided a system that comprises a housing having a light source site, a cylinder, and a divider located between the light source site and the cylinder, a light source mounted to the light source site of the housing, wherein the light source creates heat when operating, a lens mounted over the light source and sealed to the housing at the light source site, the lens thereby forming a light source enclosure and encapsulating an atmosphere around the light source within the lens, the encapsulated atmosphere having a predetermined pressure, a movable piston slidably located in the cylinder, the piston having a side surface and having an upper surface forming an air chamber between the upper surface of the piston and the divider, the piston being movable in the cylinder to adjust the size of the air chamber, and an encapsulated atmosphere conduit formed through the divider to connect the encapsulated atmosphere in the light source enclosure with the air chamber in the cylinder, wherein when the encapsulated atmosphere in the light source enclosure increases in volume and pressure due to heat generated by the LED, the increased volume of the encapsulated atmosphere flows through the conduit into the air chamber and exerts pressure against the upper surface of the piston to force the piston to move in the cylinder to increase the size of the air chamber to the extent that such piston movement is not limited by pressure of the external atmosphere against the lower surface of the piston, wherein the piston moves to a position where the pressure in the air chamber ais equal to the pressure of the external atmosphere, and wherein the reverse occurs when the encapsulated atmosphere in the light source enclosure decreases in temperature and pressure due to a lessening of heat in the light source enclosure.

In more detailed aspects in accordance with the invention, a light source driver board is mounted in the piston, the driver board having a power cable routed through the upper surface of the piston, through the air chamber, through the divider, to the light source enclosure, and electrically connected to the light source to power the light source. In other aspects, the power cable from the driver board to the light source enclosure is routed through the conduit and the light source driver board is potted in the piston.

In further aspects, a seal located between the side surface of the piston and the cylinder that seals the piston with the cylinder thereby resisting a flow of the encapsulated atmosphere out of the air chamber to outside the housing and resisting the flow of air outside the housing from flowing into the air chamber to thereby prevent contamination of the encapsulated atmosphere. In a more detailed aspect, a first groove is formed in one of the cylinder and the piston side, with the seal being mounted in the groove and a second groove formed in the other of the cylinder and the piston side, the second groove having a width larger than the seal so that the seal may move in the second groove as the piston moves in the cylinder. The width of the second groove is selected to control the movement of the piston in the cylinder to thereby control the size of the air chamber.

In other aspects of the invention, the lens has the shape of one of a dome, a closed cylinder, and a cuboid. The light source comprises a light emitting diode (LED) mounted at the light source site in the light source enclosure, and wherein the encapsulated atmosphere is selected to comprise air with a humidity level below a predetermined amount whereby moisture will not accumulate on the LED throughout a selected temperature range of operation. An LED driver board is potted in the piston, the LED driver board having an LED power cable routed through the upper surface of the piston, through the air chamber, and through the conduit to the LED to power the LED light source.

In accordance with method aspects of the invention there is provided a method of adjusting pressure to prevent contamination of an encapsulated atmosphere located about a light source, the method comprising mounting a light emitting diode (LED) at a light source site of a housing, wherein the LED creates heat when operating, mounting a lens over the LED and sealing the lens to the housing at the light source site thereby forming a light source enclosure and encapsulating an atmosphere around the LED within the lens, the encapsulated atmosphere having a predetermined pressure and humidity level, wherein the housing includes a divider located between the light source enclosure and a cylinder formed in the housing, mounting a lens over the LED and sealing the lens to the housing at the light source site thereby forming a light source enclosure and encapsulating an atmosphere around the LED within the lens, the encapsulated atmosphere having a predetermined pressure and humidity level, wherein the housing includes a divider located between the light source enclosure and a cylinder formed in the housing, mounting a slidable piston in the cylinder, the piston having a side surface and having an upper surface forming an air chamber between the upper surface of the piston and the divider, the piston being movable in the cylinder to adjust the size of the air chamber, and forming an encapsulated atmosphere conduit through the divider to connect the encapsulated atmosphere in the light source enclosure with the air chamber in the cylinder, wherein when the encapsulated atmosphere in the light source enclosure increases in volume and pressure due to heat generated by the LED, the increased volume of the encapsulated atmosphere flows through the conduit into the air chamber and exerts pressure against the upper surface of the piston to force the piston to move in the cylinder to increase the size of the air chamber to the extent that such piston movement is not limited by pressure of the external atmosphere against the lower surface of the piston, wherein the piston moves to a position where the pressure in the air chamber ais equal to the pressure of the external atmosphere, and wherein the reverse occurs when the encapsulated atmosphere in the light source enclosure decreases in temperature and pressure due to a lessening of heat in the light source enclosure.

Other method aspects include locating an LED driver board in the piston, the driver board having a power cable routed through the upper surface of the piston, through the air chamber, through the divider to the light source enclosure, and electrically connected to the LED to power the LED. Another method aspect comprises potting the LED driver board in the piston and routing the LED power cable through the conduit to the LED to power the LED light source. An additional method aspect includes locating an O-ring seal between the side surface of the piston and the cylinder to seal the piston with the cylinder thereby resisting a flow of the encapsulated atmosphere out of the air chamber to outside the housing and resisting the flow of air outside the housing from flowing into the air chamber to thereby prevent contamination of the encapsulated atmosphere.

The features and advantages of the invention will be more readily understood from the following detailed description of embodiments that should be read in conjunction with the drawings.

DETAILED DESCRIPTION OF PREFERRED EMBODIMENTS

Figure 1:
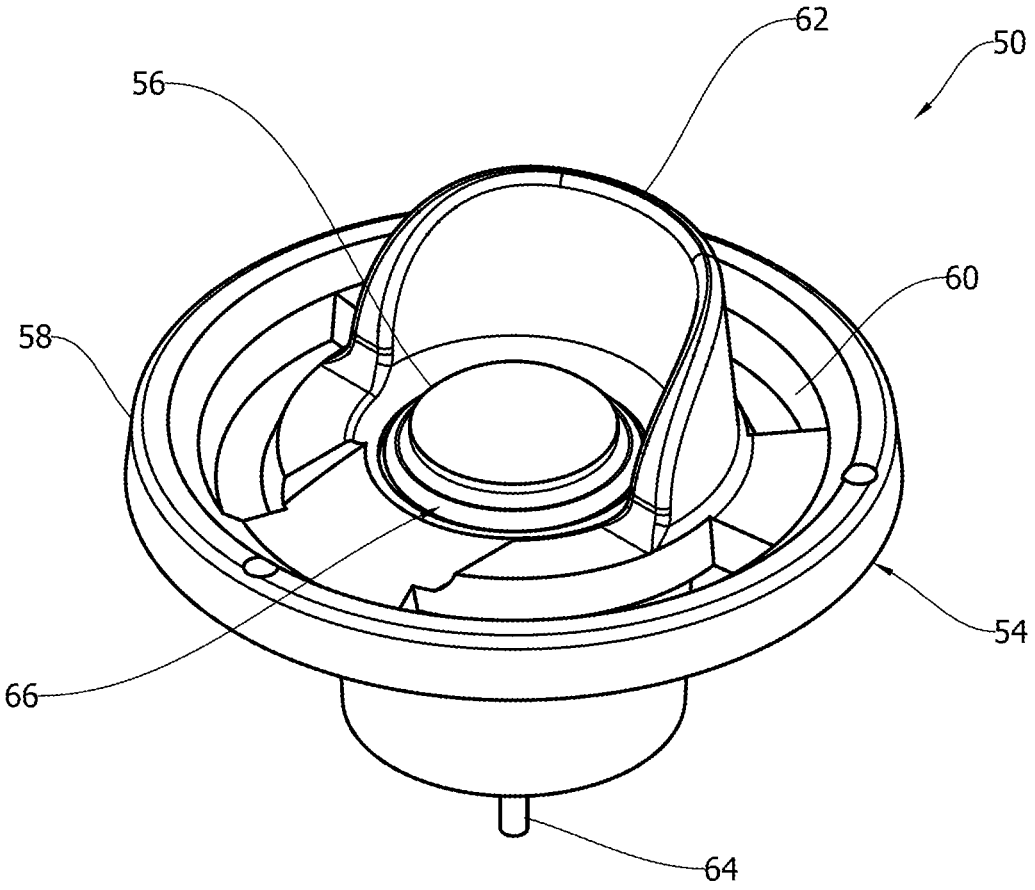
FIG. 1 is an upper perspective view of a light fixture incorporating the invention. A housing includes a heat-generating light source shown at the top which is protected from air of the outer atmosphere by a closed, cylindrically shaped lens mounted over and around the light source. The housing includes a mounting flange having multiple cutouts for draining water. The housing also includes a light shade on one side of the housing for controlling the light emission pattern of the light source.

Referring now in more detail to the exemplary drawings in which like reference numerals designate corresponding or like elements among the several views, FIG. 1 is a perspective view of a light fixture 50 incorporating a pressure adjustor to prevent contamination of a light emitting diode (LED) encapsulated atmosphere, in accordance with the invention.

A housing 54 includes a heat-generating LED light source that is protected from outside air by a closed cylindrically shaped lens 56 mounted and sealed over and around the light source. The lens is mounted to the housing in a way that seals it to the housing so that there is no ingress of air from the external atmosphere into the housing and there is no egress of the light source encapsulated atmosphere in the light source enclosure to the outside. Adhesive placed between the lens periphery and the housing may be used to affix the lens to the housing and provide a seal, in one embodiment. Although not shown, the light emitting diode or diodes are mounted to an LED mounting board and both are mounted at a light source site 114 (see FIG. 4) on the housing under the lens. The combination of the lens, the LED light source, and the light source site form the light source enclosure 66.

The housing includes a mounting flange 58 having multiple cutouts 60 for draining water. The housing also includes a light shade 62 on one side of the housing for controlling and shaping the light emission pattern of the LED light source. A power cable 64 is shown at the bottom of the figure for providing operation power to the LED light source and its driver board (not shown). The size and shape of the light fixture 50 of FIG. 1 can take many different forms. FIG. 1 only presents one example of a light fixture.

Figure 2:
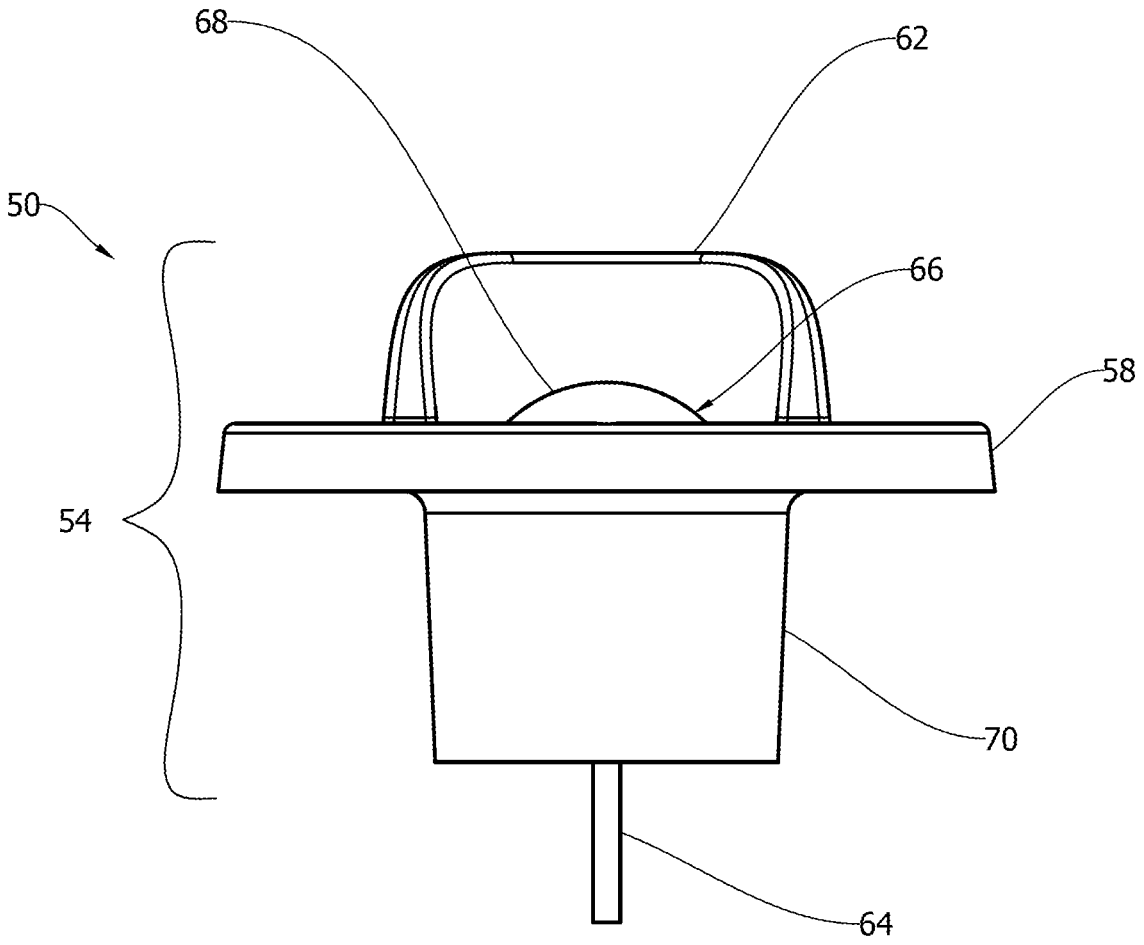
FIG. 2 is a front elevation view of the light fixture of FIG. 1 showing the housing of the light fixture and the lens located over the light source that forms the light source enclosure, wherein the lens in this embodiment is dome-shaped. The figure also shows the part of the housing below the flange that contains a cylinder in which is housed an air expansion chamber in accordance with aspects of the invention to control the pressure of the internal, encapsulated air of the light source in accordance with aspects of the invention.

FIG. 2 is a front elevation view of the light fixture 50 of FIG. 1 showing the housing 54 of the light fixture and the lens 68 located over the light source (not shown) that forms the light source enclosure 66. The lens in this embodiment is dome-shaped. The part of the housing below the flange 58 is a cylinder 70 that contains a bore in which is formed an air expansion chamber in accordance with aspects of the invention, to adjust pressure. These features are described in more detail below.

Figure 3:
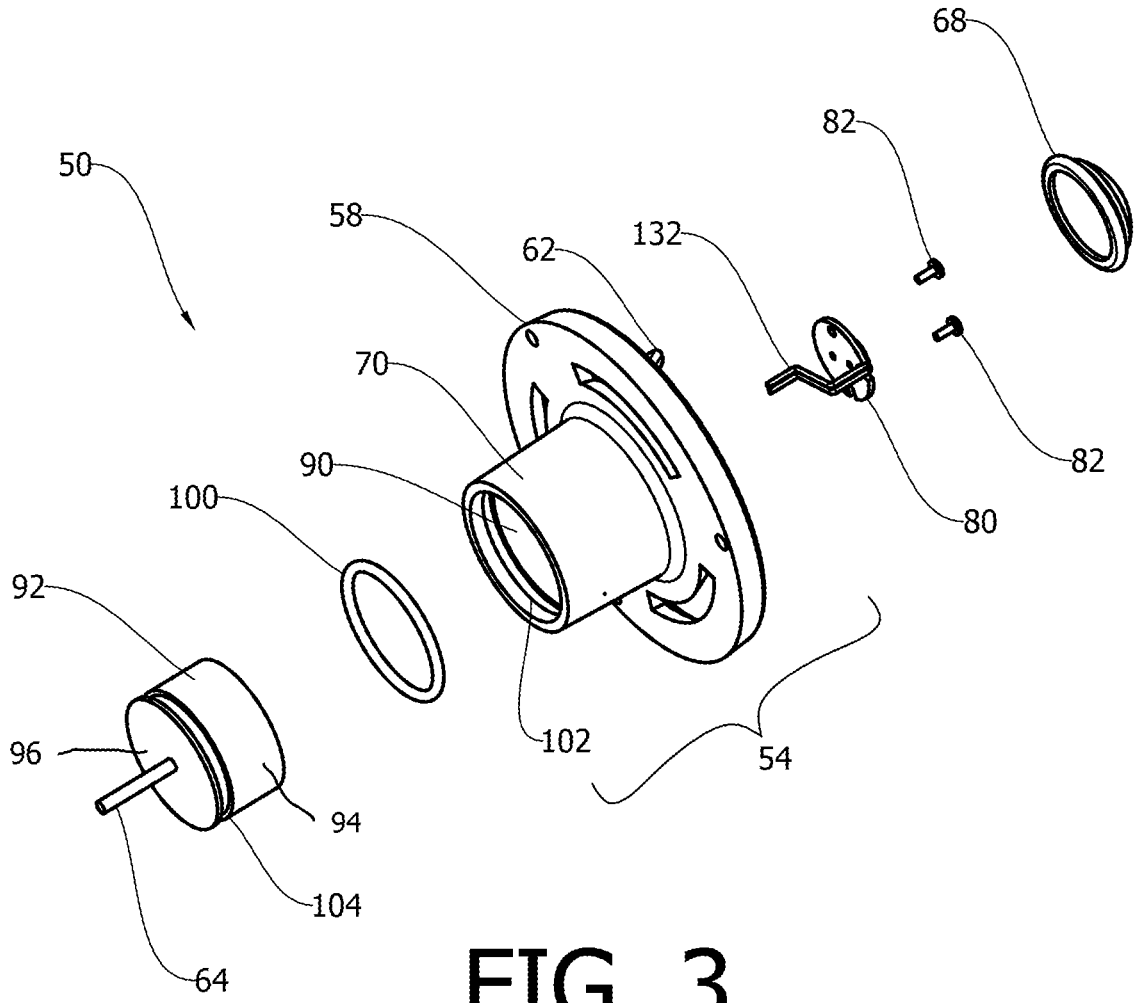
FIG. 3 is an exploded view of the light fixture of FIGS. 1 and 2 showing the various components used to provide light and at the same time, to protect the light source by controlling the pressure of internal air located about the light source to equal the atmospheric pressure of air outside the light fixture to prevent contamination of the light source.

Moving now to FIG. 3, an exploded view of the light fixture 50 of FIGS. 1 and 2 is shown. Various components that make up the light fixture and form a pressure adjustor system in accordance with the invention are shown. The lens 68 is dome shaped in this view. An LED mounting board 80 includes one or more LEDs and protective circuitry such as a metal oxide varistor, or other safety elements. It also may include anode and cathode contacts for power to operate the LED. Screws 82 are used for securing the LED mounting board to a light source site on the housing 54. A power cable 132 is shown that provides power to the LED mounting board to operate the LED light source.

The exploded view of FIG. 3 is also a bottom perspective view and in this case, the cylinder 70 part of the housing is shown with a bore 90 for accepting a piston 92. A seal, in the form of an O-ring 100 is shown for sealing the piston within the bore 90 of the cylinder. In this embodiment, both the bore of the cylinder 70 and the outer surface of the piston 94 have seal grooves 102 and 104 respectively. In one embodiment, the width of the groove on the piston is approximately the size of the width of the O-ring while the groove in the bore 102 of the cylinder is wider, so that the piston may move in both directions within the bore by the distance of the width of the groove in the bore more easily. However, in order to seal effectively, the O-ring 100 must be in compression.

This seal is used to block the passage of the encapsulated atmosphere inside the housing from escaping into the outside atmosphere and to block the passage of air from the outside atmosphere from entering into the housing, and in particular blocking air from the outside atmosphere from reaching the air chamber, as is discussed below. At the same time, the purpose of the piston is to move inside the bore to adjust the pressure inside the housing, as is discussed below. The figure also shows the lower surface 96 of the piston which will be in contact and subject to pressure of the outside atmosphere. The power cable 64 is shown mounted through the lower surface 96 of the piston.

Figure 4:
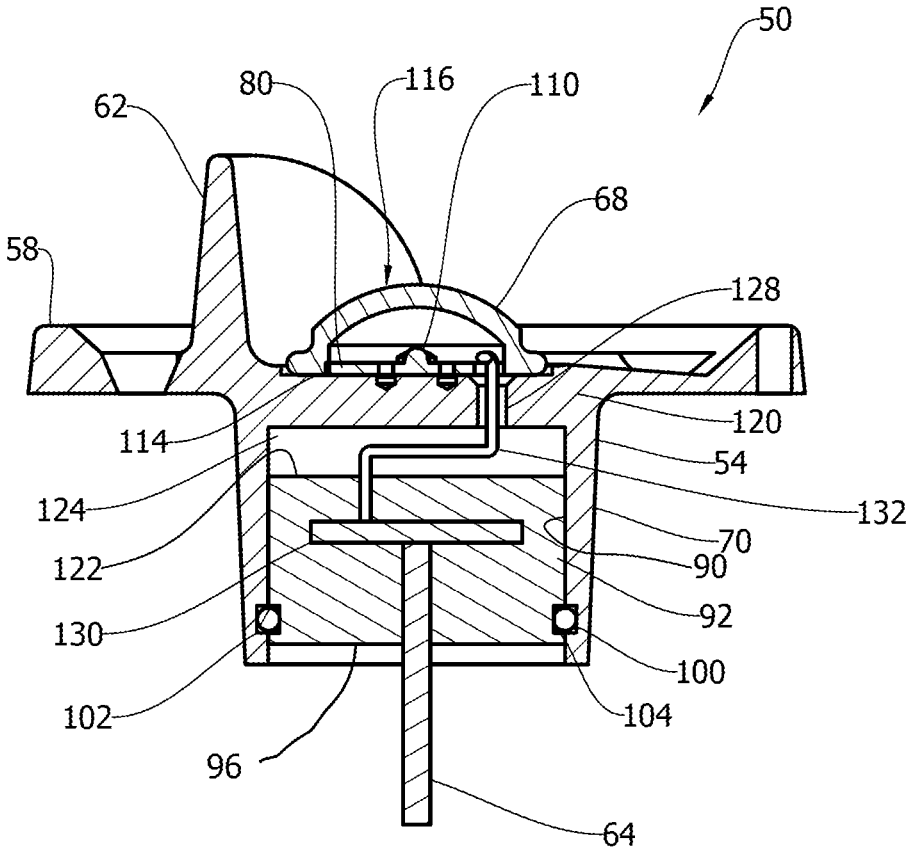
FIG. 4 is a cross section view of the light fixture of FIGS. 1 and 2 showing the assembly of the various components of FIG. 3 that operate in accordance with aspects of the invention to provide protection of the light source from contamination by the external atmosphere. In this embodiment, the light source comprises at least one light emitting diode (LED) mounted on an LED mounting board sealed under a dome-shaped lens that forms the light source enclosure. An air chamber is formed by a piston in the cylinder of the housing and the chamber is connected with the light source enclosure by a conduit. The lower surface of the piston is exposed to external atmosphere air pressure and the piston moves in the chamber to equalize the pressure of the air in the air chamber with the pressure of the air of the external atmosphere. The figure also shows an LED driver board located in the piston.

FIG. 4 is a cross sectional view of the light fixture 50 of FIGS. 1 and 2 and shows a pressure adjustor system to prevent contamination of an encapsulated atmosphere to avoid premature failure of the LED light source. FIG. 4 also shows the assembly of the various components of FIG. 3 so that their interaction and operation can be more clearly understood. In this embodiment, the light source comprises at least one LED 110 mounted on an LED mounting board 80 under a dome-shaped lens 68. The LED, LED mounting board, and lens are mounted at a light source site 112 on the housing 54. The combination of a lens and the LED light source located at the light source site is referred to as the light source enclosure 116. The lens is sealed to the housing at the light source site by adhesive or other means for the purpose of preventing air from the outside atmosphere from reaching the LED light source and for the purpose of preventing the encapsulated atmosphere located in the light source enclosure from egress to the outside atmosphere.

The light fixture 50 also includes an internal divider 120 located between the light source enclosure 116 and the bore 90 of the cylinder 70 part of the housing. It can be seen from FIG. 4 that the upper surface 122 of the piston has left an air chamber 124 between it and the divider. A conduit 128 has been formed through the divider and interconnects the light source enclosure 116 with the air chamber 124. That is, the atmosphere encapsulated in the light source enclosure 116 may freely flow through the conduit into the air chamber 124, and vice versa. The air pressure in the light source enclosure, in the conduit, and in the air chamber is therefore the same. It operates as a closed system. The position of the sealed piston 92 in the bore 90 of the cylinder 70 will control the pressure because it will control the volume of the air chamber. All other things remaining the same, moving the piston up to decrease the volume in the air chamber will increase the pressure of the encapsulated atmosphere in the light source enclosure, in the conduit, and in the air chamber. Moving the piston down to increase the volume in the air chamber will decrease the pressure of the encapsulated atmosphere in the light source enclosure, in the conduit, and in the air chamber.

In FIG. 4, it will be seen that the piston 92 is simultaneously subject to two pressures. The encapsulated internal atmosphere pressure of the light source enclosure and air chamber changes as the LED gets hotter or cooler and exerts pressure on the upper surface 122 of the piston to either make the air chamber larger or smaller as the case may be. At the same time, the outside atmospheric pressure exerts pressure on the lower surface 96 of the piston. Thus, if the encapsulated atmosphere has a pressure greater than the outside atmospheric pressure, the piston will move to enlarge the air chamber until the pressures are equal. Conversely, if the encapsulated atmosphere has a pressure that is lower than the outside atmospheric pressure, the piston will move to reduce the size of the air chamber until the pressures are equal. Consequently, the seal or seals of the light source enclosure are not subjected to elevated pressures, either from within or from without, and the potential for failure of the seal or seals is lessened.

As the LED is turned on and heats up the LED mounting board 80 and the housing 54, the encapsulated atmosphere will heat up and would exert pressure on seals surrounding the LED but for the piston that will move as needed to make the pressure inside the light source enclosure to equal the pressure outside the light source enclosure. Consequently, no additional pressure will be exerted against the seal. Because the encapsulated atmosphere of the light source enclosure, conduit, and air chamber is a closed system, the atmosphere pressure inside it will automatically be equalized with the outside atmosphere through all heating and cooling cycles of the LED (creating heat due to operation, and the heat dissipating when the LED is not operating). Thus, the seals of the light fixture will not be subjected to increased stress that would normally be caused by the heating and cooling cycles of LED operation, and corrosive and/or moist air external to the light fixture will not be drawn into the light fixture to damage the LED. The LED will only be subjected to the contents of the encapsulated atmosphere that were introduced during the manufacturing process of the light fixture.

During manufacture, the humidity of the encapsulated (internal) atmosphere and its pressure may both be carefully controlled as the light fixture is assembled. Because of the benefits of the pressure adjustor to prevent contamination of the LED in accordance with the invention, the pressure of the encapsulated atmosphere in the light source enclosure, conduit, and air chamber set during manufacture is continually maintained by the movable piston. The contents of the encapsulate atmosphere are also unchanged during use of the light fixture thereby preventing moisture or corrosive air from damaging the LED. This has the effect of increasing the serviceable life of the LED and the light fixture, lessening the chances of LED failure, and lowers costs.

FIG. 4 also shows an LED driver circuit board 130 potted in the piston 92. Every LED light source requires a driver. LED drivers (also known as LED power supplies) are similar to ballasts for fluorescent lamps or transformers for low-voltage bulbs: they provide LEDs with the correct power supply to function and perform at their best. A power cable 64 brings power to the driver board and from there, the driver board provides an LED power cable 132 through the upper surface 122 of the piston, through the air chamber 124, through the conduit 128, and into the light source enclosure 116 for connection with the LED mounting board 80 to provide power to illuminate the LED 110. As discussed above, the piston is movable to adjust the size of the air chamber, through which the power cable is run. For this purpose, the length of the power cable through the air chamber is lengthened to accommodate the largest size of the air chamber expected. The power cable will then not interfere with movement of the piston.

Figure 5:
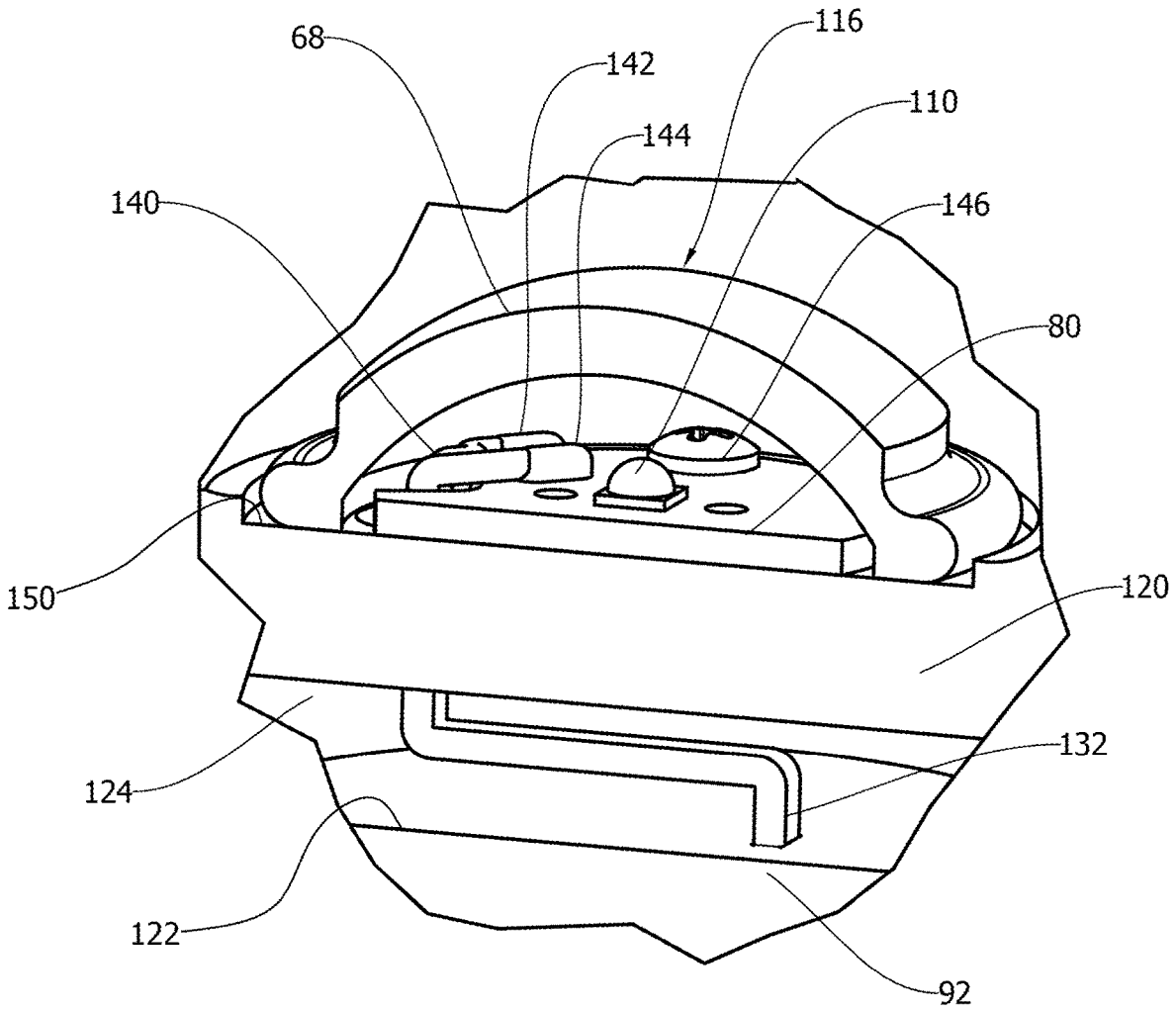
FIG. 5 is a larger perspective view of the light source enclosure of the housing of FIG. 4 in which the LED light source is shown with the dome-shaped lens. Also shown in the drawing is the power cable, the wires of which are connected to the LED mounting board and the conduit through which the LED power cable is brought into the light source enclosure.

FIG. 5 is a larger perspective view of the light source enclosure 116 of the housing 54 in which the LED mounting board 80 and LED light source 110 of FIG. 4 are shown mounted under the dome-shaped lens 68. Also shown in the drawing is the divider 120 of the housing, the air chamber 124, and the power cable 132 that interconnects the LED driver board (not shown) with the LED mounting board 80. At the LED mounting board, the power cable is separated into its positive and negative wires 140 and they are connected to the appropriate anode and cathode contacts 142 and 144 on the LED mounting board to provide power to the LED light source. A screw 146 is shown that attaches the LED mounting board to the upper surface 150 of the divider 120.

The drawing shows that the power cable 132 from the potted LED driver board 130 to the LED mounting board 80 is a continuous cable. However, in another embodiment not shown here, the LED mounting board may have its own cable and the LED driver board may have its own, separate cable. The two cables may be connected together in the air chamber 124 for ease of manufacture. Standard connection techniques may be used. In one case, the wires of the cables are spliced together, and heat shrink tubing used over the connection to secure it and protect it from moisture or other elements that may tend to cause a fault at the connection. Other connection techniques may be used.

The solution shown herein to shape the potted driver board into a piston with one or two grooves to receive an O-ring under compression has been found to work well. This makes the LED driver board/O-ring assembly into a piston that can move in the bore of the cylinder of the housing. As the piston moves it allows for the expansion of the encapsulated atmosphere around the LED to be contained in the light fixture by the increased pressure moving the piston. No dry air escapes. When the light fixture turns off the air cools and the piston will retract into the cylinder to compensate for the reduced volume of the cooling air. No new air enters from the outside atmosphere. The O-ring must be in compression in the embodiments shown.

In the past, assembly of a lens 68, an LED mounting board 80, and a casting (housing) used in a low voltage outdoor landscape light faced the problem of damaged LEDs. When the light goes on the LED mounting board heats up and transfers the heat to the casting. The casting metal expands. The air captured under the lens and the area where wire connections are made heats up and expands. The potted driver board and the O-ring assembly are inserted into the machined smooth bore and the O-ring goes into a groove in the internal machined section of the bore. The O-ring must be under compression and the potted driver piston will move in the machined bore of the casting. Through relief of the pressure by the piston action and the seal made by the compressed O-ring, the system of the invention will permanently separate the outside atmosphere from the inside atmosphere that was controlled at the factory. This system in accordance with the invention is designed to go into any metal casting light fixture body.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Unless the context requires otherwise, throughout the specification above and claims that follow, the word "comprise" and variations thereof, such as, "comprises" and "comprising" are to be construed in the normal patent law sense; i.e., an open, inclusive sense, which is as "including, but not limited to."

As used herein, a "lens" is a thin piece of glass or plastic or other material that transmits light with or without refraction.

As used herein, the term "board" is meant in a general sense. In the case of a "driver board," the term board is meant to refer to various configurations of driver circuitry whether it is located on a flat board, or on other types of circuit mounting devices.

As used herein, the term "potting" refers to a process of filling a complete electronic assembly with a solid or gelatinous compound to exclude gaseous phenomena such as corona discharge, for resistance to shock and vibration, and for the exclusion of water, moisture, or corrosive agents.

While the present invention has been described herein in terms of certain preferred embodiments, those skilled in the art will recognize that modifications and improvements may be made without departing from the scope of the invention. The exemplary embodiment described above is not intended to represent all possible forms of the invention. Rather, the words used in the specification are words of description of an embodiment, not limitations on the invention itself, and it is understood that various changes may be made to the embodiments without departing from the scope of the invention.

What is claimed is:

1. A pressure adjustor system to prevent contamination of an encapsulated atmosphere located about a light source mounted in a light fixture, by air from an external atmosphere to the light fixture, the system comprising:

a housing having a light source site, a cylinder, and a divider located between the light source site and the cylinder;

a light source mounted to the light source site of the housing, wherein the light source creates heat when operating;

a lens mounted over the light source and sealed to the housing at the light source site, the lens thereby forming a light source enclosure and encapsulating an internal atmosphere around the light source within the lens, the encapsulated atmosphere having a pressure;

a movable piston slidably located in the cylinder, the piston having a side surface and a lower surface, the lower surface being exposed to pressure of the external atmosphere, the piston further having an upper surface that forms an air chamber between the upper surface of the piston and the divider, the piston being movable in the cylinder to adjust the size of the air chamber;

an encapsulated atmosphere conduit formed through the divider to connect the encapsulated atmosphere in the light source enclosure with the air chamber in the cylinder; and a light source driver board mounted in the piston, the light source driver board having a light source power cable routed through the upper surface of the piston, through the air chamber, through the divider, to the light source enclosure, and electrically connected to the light source to power the light source;

wherein when the encapsulated atmosphere in the light source enclosure increases in volume and pressure due to heat generated by the light source, the increased volume of the encapsulated atmosphere flows through the conduit into the air chamber and exerts pressure against the upper surface of the piston to force the piston to move in the cylinder to increase the size of the air chamber to the extent that such piston movement is not limited by pressure of the external atmosphere against the lower surface of the piston, wherein the piston moves to a position where the pressure in the air chamber is equal to the pressure of the external atmosphere, and wherein the reverse occurs when the encapsulated atmosphere in the light source enclosure decreases in temperature and pressure due to a lessening of heat in the light source enclosure.

2. The pressure adjustor system of claim 1 wherein the light source power cable from the light source driver board to the light source enclosure is routed through the conduit.

3. The pressure adjustor system of claim 1 wherein the light source driver board is potted in the piston.

4. The pressure adjustor system of claim 1 further comprising a seal located between the side surface of the piston and the cylinder that seals the piston with the cylinder thereby resisting a flow of the encapsulated atmosphere out of the air chamber to outside the housing and resisting a flow of air from outside the housing into the air chamber.

5. The pressure adjustor system of claim 4 further comprising a first groove formed in one of the cylinder and the piston side, with the seal being mounted in the groove.

6. The pressure adjustor system of claim 5 further comprising a second groove formed in the other of the cylinder and the piston side, the second groove having a width larger than the seal so that the seal may move in the second groove as the piston moves in the cylinder.

7. The pressure adjustor system of claim 4 wherein the seal comprises an O-ring.

8. The pressure adjustor system of claim 1 wherein the lens has the shape of one of a dome, a closed cylinder, and a cuboid.

9. The pressure adjustor system of claim 1 wherein the light source comprises a light emitting diode (LED) mounted at the light source site in the light source enclosure, and wherein the encapsulated atmosphere is configured to comprise air with a humidity level below a predetermined amount whereby moisture will not accumulate on the LED throughout a selected temperature range of operation.

10. The pressure adjustor system of claim 9 wherein the light source driver board comprises a light emitting diode (LED) driver board potted in the piston, wherein the light source power cable comprises an LED power cable connected to the LED driver board and routed through the upper surface of the piston, through the air chamber, and through the conduit to the LED to power the LED.

11. The pressure adjustor system of claim 10 wherein the potted LED driver board comprises an LED driver board power cable that is potted in the piston at its connection to the LED driver board to provide power to the LED driver board.

12. A pressure adjustor system to prevent contamination of an encapsulated atmosphere located about a light emitting diode (LED) light source mounted in a light fixture, by air from an external atmosphere to the light fixture, the system comprising:

a housing having a light source site, a cylinder, and a divider located between the light source site and the cylinder;

an LED mounted to the light source site of the housing, wherein the LED creates heat when operating;

a lens mounted over the LED and sealed to the housing at the light source site, the lens thereby forming a light source enclosure and encapsulating an internal atmosphere around the LED within the lens, the encapsulated atmosphere having a pressure and humidity level;

a movable piston slidably located in the cylinder, the piston having a side surface and a lower surface, the lower surface being exposed to pressure of the external atmosphere, the piston further having an upper surface that forms an air chamber between the upper surface of the piston and the divider, the piston being movable in the cylinder to adjust the size of the air chamber;

an encapsulated atmosphere conduit formed through the divider to connect the encapsulated atmosphere in the light source enclosure with the air chamber in the cylinder; and a light source driver board potted in the piston, the driver board having a power cable routed through the upper surface of the piston, through the air chamber, through the conduit, to the light source enclosure, and electrically connected to the LED to power the LED;

wherein when the encapsulated atmosphere in the light source enclosure increases in volume and pressure due to heat generated by the LED, the increased volume of the encapsulated atmosphere flows through the conduit into the air chamber and exerts pressure against the upper surface of the piston to force the piston to move in the cylinder to increase the size of the air chamber to the extent that such piston movement is not limited by pressure of the external atmosphere against the lower surface of the piston, wherein the piston moves to a position where the pressure in the air chamber ais equal to the pressure of the external atmosphere, and wherein the reverse occurs when the encapsulated atmosphere in the light source enclosure decreases in temperature and pressure due to a lessening of heat in the light source enclosure.

13. The pressure adjustor system of claim 12 further comprising an O-ring seal located between the side surface of the piston and the cylinder that seals the piston with the cylinder thereby resisting a flow of the encapsulated atmosphere out of the air chamber to outside the housing and resisting a flow of external air from outside the housing into the air chamber.

14. The pressure adjustor system of claim 13 further comprising a first groove formed in one of the cylinder and the piston side, with the O-ring seal being mounted in the groove.

15. The pressure adjustor system of claim 14 further comprising a second groove formed in the other of the cylinder and the piston side, the second groove having a width larger than the O-ring seal so that the O-ring seal may move in the second groove as the piston moves in the cylinder.

16. A method of adjusting pressure to prevent contamination of an encapsulated atmosphere located about a light source, the method comprising:

mounting a light emitting diode (LED) at a light source site of a housing, wherein the LED creates heat when operating;

mounting a lens over the LED and sealing the lens to the housing at the light source site thereby forming a light source enclosure and encapsulating an atmosphere around the LED within the lens, the encapsulated atmosphere having a predetermined pressure and humidity level, wherein the housing includes a divider located between the light source enclosure and a cylinder formed in the housing;

mounting a slidable piston in the cylinder, the piston having a side surface, a lower surface, and an upper surface forming an air chamber between the upper surface of the piston and the divider, the piston being movable in the cylinder to adjust the size of the air chamber;

mounting an LED driver board in the piston, wherein the LED driver board has an LED power cable routed through the upper surface of the piston, through the air chamber, through the divider to the light source enclosure, and electrically connected to the LED to power the LED; and forming an encapsulated atmosphere conduit through the divider to connect the encapsulated atmosphere in the light source enclosure with the air chamber in the cylinder;

wherein when the encapsulated atmosphere in the light source enclosure increases in volume and pressure due to heat generated by the LED, the increased volume of the encapsulated atmosphere flows through the conduit into the air chamber and exerts pressure against the upper surface of the piston to force the piston to move in the cylinder to increase the size of the air chamber to the extent that such piston movement is not limited by pressure of the external atmosphere against the lower surface of the piston, wherein the piston moves to a position where the pressure in the air chamber ais equal to the pressure of the external atmosphere, and wherein the reverse occurs when the encapsulated atmosphere in the light source enclosure decreases in temperature and pressure due to a lessening of heat in the light source enclosure.

17. The method of adjusting pressure of claim 16 wherein the step of mounting the LED driver board in the piston further comprising potting the LED driver board in the piston, and wherein the LED power cable is routed through the upper surface of the piston, through the air chamber, and through the atmosphere conduit to the LED to power the LED.

18. The method of adjusting pressure of claim 16 further comprising locating an O-ring seal between the side surface of the piston and the cylinder to seal the piston with the cylinder thereby resisting a flow of the encapsulated atmosphere out of the air chamber to outside the housing and resisting a flow of external air from outside the housing into the air chamber.

* * * * *